United States Patent [19]

Miettinen

[11] Patent Number: 4,930,387

[45] Date of Patent: Jun. 5, 1990

[54] ADJUSTABLE CIRCULAR SAW

[75] Inventor: Lauri O. Miettinen, Heinola, Finland

[73] Assignee: A. Ahlstrom Corporation, Noormarkku, Finland

[21] Appl. No.: 368,728

[22] Filed: Jun. 20, 1989

[30] Foreign Application Priority Data

Jul. 15, 1988 [FI] Finland ..... 883366

[51] Int. Cl.[5] ..... B27B 5/34

[52] U.S. Cl. ..... 83/508.3; 83/425.4; 83/368; 83/499

[58] Field of Search ..... 83/425.4, 504, 498, 83/499, 665, 508.2, 508.3, 368

[56] References Cited

U.S. PATENT DOCUMENTS 969,810 9/1910 Skerth ..... 83/425.4

3,885,483 5/1975 Ikeya et al. ..... 83/368

4,548,109 10/1985 Tokuno et al. ..... 83/499

*Primary Examiner*—Frank T. Yost

*Assistant Examiner*—Hwei-Siu Payer

*Attorney, Agent, or Firm*—Nixon & Vanderhye

[57] ABSTRACT

A circular saw has adjustable blades mounted on a splined blade arbor. A guide engages a portion of each blade spaced from the blade arbor so as to facilitate movement of the blade along the blade arbor without tilting or canting. The guides are mounted on a guide arbor. Each blade and associated guide are connected to an actuator by shifter bars which are slideably disposed in the splines. The actuator comprises a connecting plate, each connecting plate being provided with a shifting cylinder for effecting movement of the mounting plate and associated simultaneous displacement of an equal amount by the blade and guide associated with it. Preferably three round shifter bars disposed in half-round splines circumferentially spaced 120° from each other are associated with each blade and guide. The mounting plates are disposed on shafts having gear wheels at their opposite end cooperating with racks.

16 Claims, 2 Drawing Sheets

ADJUSTABLE CIRCULAR SAW

Figure 1:
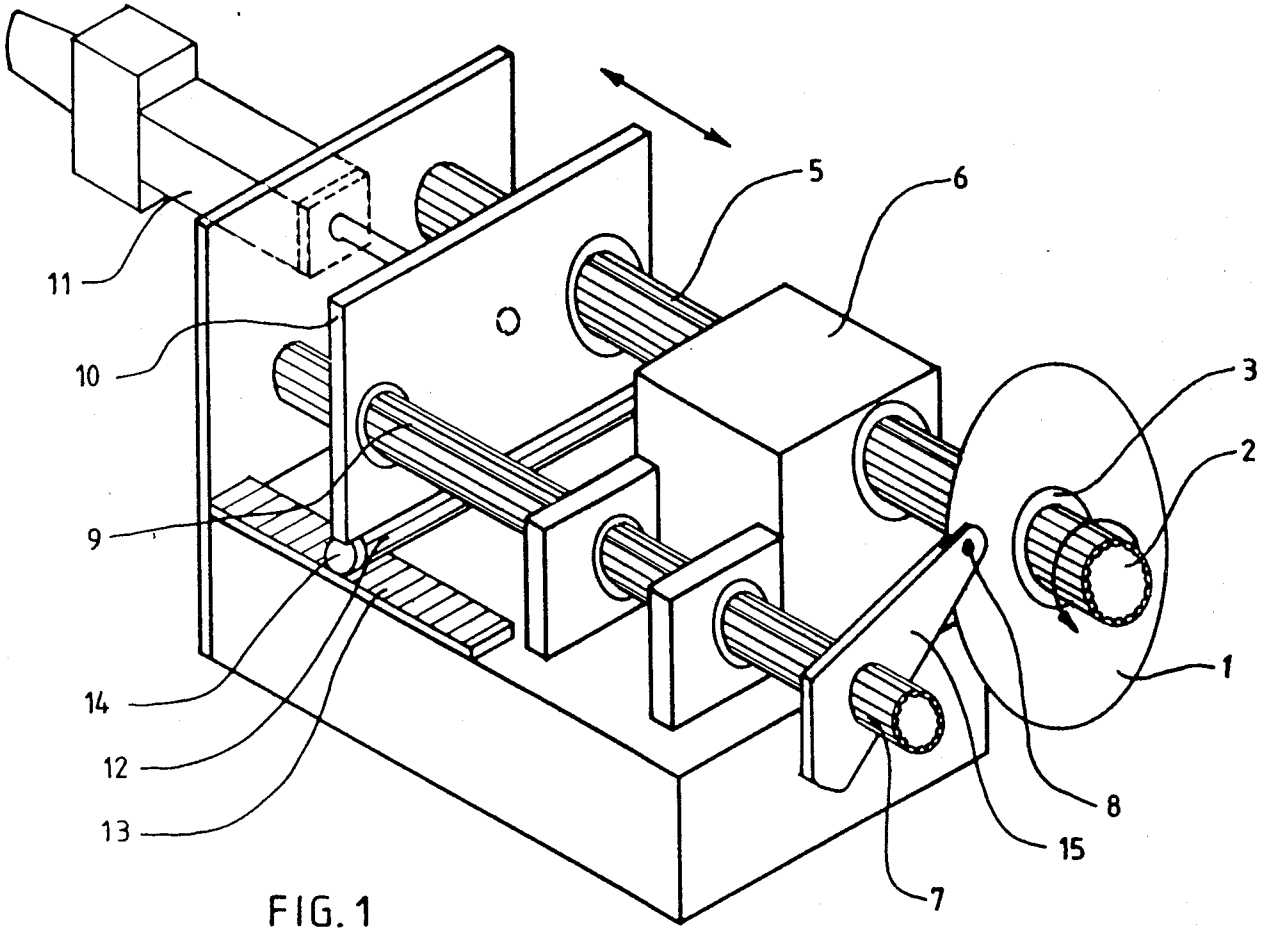

The present invention relates to a circular saw provided with circular saw blades which are adjustable relative to each other and disposed side by side on a splined arbor.

Circular saws are nowadays commonly used in various stages of saw processes. First, the log is sawn by circular saws into a cant. In the next stage, the cant is sawn by a circular saw into both timber of a smaller dimension and side boards. The side boards may also be edged by a circular saw. Trim saws form a group of their own.

The circular saws stand in comparison with sawmill machines based on other sawing methods primarily because of their inexpensive purchase price and because they are easy to place.

In cutting crooked cants, crook-sawing has strongly increased due to the higher yield.

The capacity of sawing logs and cants individually according to quality is an absolute prerequisite for a modern sawing line. Thus, a quick set adjustment of the saw blades is required of a circular saw for cutting cants. The spacing between the blades varies within a wide range depending on the quality of the cant.

The following characteristics are demanded of an adjustable saw:

- quick and precise shifting of the saw blades
- as many adjustable saw blades as possible
- a sufficiently small minimum spacing between the saw blades
- the saw blades must be well guided and supported in order to achieve exact dimensions of the sawn timber.

The circular saws presently used can be roughly divided into two groups, i.e. circular saws with a single arbor and those with a double arbor.

In the circular saws with a single arbor, which are the most commonly used type of circular saws, the saw blades are shifted by means of the blade guides. The guides are moved by a shifting cylinder. The blade arbor is splined. The center hole of the blade and the cross section of the arbor are similar in shape. The saw blade moves directly on the surface of the arbor. In some constructions, the blade center is provided with a flange thicker than the blade body. In this manner, a larger bearing surface for a torque transfer is obtained between the saw blade and the arbor, resulting in less wear of the arbor.

A cant of 275 mm requires a saw blade diameter of, for example, 700 to 800 mm depending on the diameter of the blade arbor. In such arrangements, the blade guide has to extend near the blade center because, otherwise the blade would become askew and the axial shifting would consequently fail because of the narrow guide surface between the blade and the arbor. The narrow guide surface causes two major disadvantages for this structure. Firstly, since the blade guide is long it is therefore difficult to make such thin enough so as to obtain sufficiently narrow spacings between the saw blades. The minimum spacing between the saw blades is about 32 mm in such systems.

Secondly, the vertical stability of the saw blade is poor. The saw blade is held in a vertical plane merely by the guides because there is no guide surface between the saw blade and the arbor. Even a normal clearance between the saw blade and the guide results in that the blade becomes askew instead of staying vertical. Thus, the best possible dimensional precision is not obtained. Furthermore, the present constructions only include four adjustable saw blades.

A previously known circular saw with a double arbor is provided with four blade arbors. Firstly, it has a top arbor and a bottom arbor. Secondly, the saw is divided into two parts relative to the centerline. The blade arbor is composed of tubes inserted one inside another, said tubes being moved respective to each other by means of shifting cylinders.

In this type of a saw, the saw blades are not usually provided with guides because the blades are relatively small in diameter. The saw blade is firmly fixed at its center. With higher cants, the saw blades are thicker than in a circular saw with a single arbor. A lateral deviation in the set of the blades on the top and the bottom arbors is easily seen in the sawn timber. The deviation is further increased by crook-sawing because the arbors are not in the same vertical plane.

If, in a saw with no blade guides, the thickness of the saw blade is not correct in relation to the blade diameter and to the size of a blade holder, this will readily lead to blade damage and, consequently, shut-downs in the production.

In the above-described saw, the number of adjustable saw blades is four. The arbors of the blades disposed nearest to the centerline extend through the drive motors, which requires expensive special motors. This construction with four blade arbors is also otherwise highly expensive in relation to its properties.

U.S. Pat. No. 3,630,244 discloses an adjustable saw construction. In this construction, the blade arbor is composed of several tubes inserted one inside another. Each tube is correspondingly connected with a saw blade. This arrangement can only be used where there are three or less than three adjustable saw blades.

U.S. Pat. No. 3,202,189 discloses a circular saw with adjustable circular saw blades disposed on a splined arbor. Lateral shifting of the the saw blades is effected by shifter bars slidably disposed in the splines of the blade arbors. There are no blade guides and the saw can therefore only be used for sawing thin lumber with small blades.

The drawbacks of the constructions described above are eliminated or minimized by the invention to be described below. The adjustable circular saw according to the invention meets all requirements stated above.

The circular saw according to the invention is characterized in that mounting means and guides are provided for the circular saw blades and are adjustably disposed on splined arbors with said mounting means and guides being connected with displacing or shifter bars, which are slidably disposed in the splines matching or cooperating with the shape of the shifter bars and which shifter bars for a respective mounting means and guide are connected with the same actuator so as to provide a simultaneous displacement of equal amount both the mounting means and the guide of a respective circular saw blade.

Each circular saw blade and guide is preferably connected with three circular shifter bars at a spacing of 120°.

Figure 2:
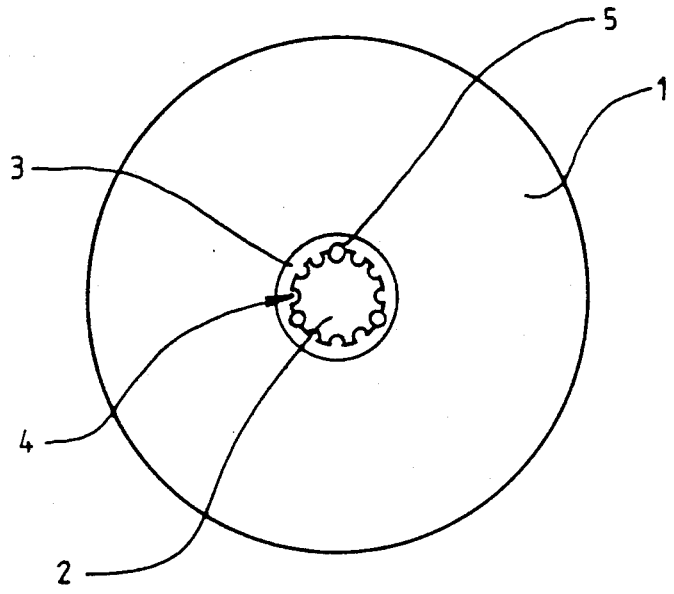
Figure 3:
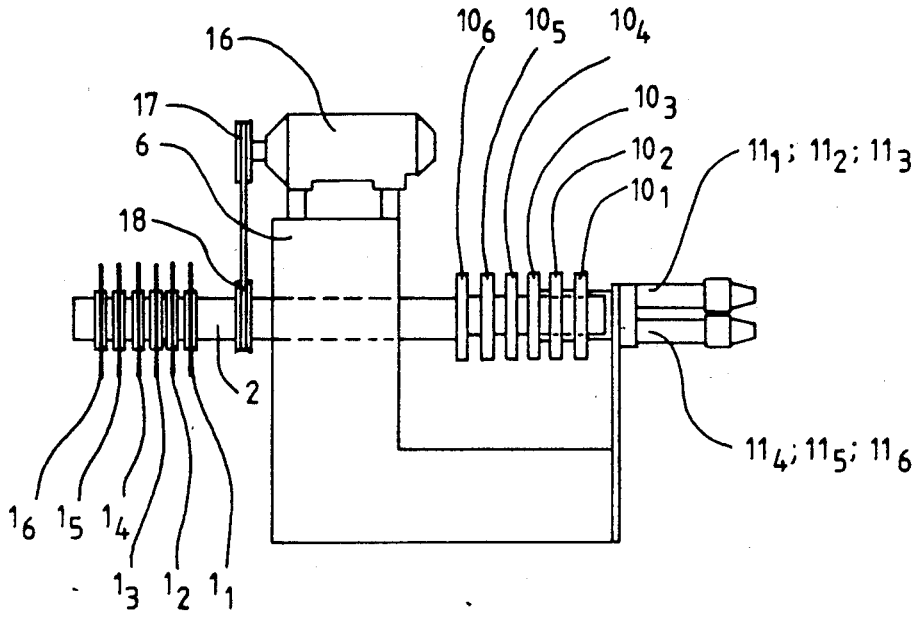

The invention will be described more in detail by way of example, with reference to the accompanying drawings, in which FIG. 1 is a schematic perspective view illustrating the operating principle of an apparatus according to the invention, FIG. 2 is a cross section of a blade arbor, and FIG. 3 is a schematic side view of an apparatus according to the invention, having six circular saw blades.

To clearly illustrate the invention, FIG. 1 shows only one movable circular saw blade 1. For the same reason, the drive means rotating the blade arbor 2 is not shown. The blade arbor is splined. Its cross section is illustrated in FIG. 2. On both sides of the circular saw blade are provided flange-type thin clamping means 3, between which the saw blade is pressed. In the splines 4 of the arbor are slidably disposed round bars 5 matching the splines in such a manner that each clamping flange is connected with three bars, such being disposed in the splines of the blade arbor at 120° spacing. If the number of adjustable saw blades is, for example, six, the number of splines in the blade arbor will be 18. The blade arbor with bars is mounted on bearings in the saw frame 6.

The circular saw blade is guided from the outer surface thereof by a previously known guide system affecting the side surfaces of the circular saw blade. The cross section of an arbor 7, on which guides 8 move, is similar to that of the blade arbor 2. Each guide is connected with three shifter bars 9 (only one shown) disposed at 120° spacing. One end of each bar of the blade arbor and one end of each shifter bar of the guide shaft is attached to a common connecting plate 10 of a plurality thereof. Attached to the connecting plate 10 is also a shifting cylinder 11. The cylinder first transmits power to the connecting plate, wherefrom it is further transmitted through shifter bars 5 and 9 to the clamping flanges 3 in the blade center and through the bars of the blade guide arbor 7 to the blade guide 8. When the shifting cylinder is in operation, the center and the outer edge of each saw blade are subject to a force shifting the blade axially. In this manner, the blades are shifted evenly and firmly with no tilting from one setting to another. The connecting plate can be further provided with a synchronizing shaft 12 mounted on bearings of said connecting plate, gearwheels 14 rolling along a feed rack 13 being attached to both ends of said synchronizing shaft, which ensures a simultaneous movement of the shifter bars of both the blade arbor and the guide arbor. Some other parallel displacement mechanism can of course substitute for the mechanism comprising a synchronizing shaft, a gearwheel and a feed rack.

The torque from the blade arbor is transmitted to the saw blade by means of the shifter bars in the splines of the arbor. Shifting of the saw blades is effected when sawing is not under way, i.e. there is no lumber between the saw blades. Shifting of the saw blades can also be carried out when the blades are not rotating, which is not possible in known saw machines in which the blades are only shifted through guides.

The shifter bars attached to the clamping flange of the saw blade hold the blade in a vertical plane since there is a long guide surface between the saw blade and the blade arbor.

The arm 15 of the guide is short because the guidance is effected from the outer periphery only. The short guide arm as well as the clamping flanges of the saw blade can be made sufficiently thin so that narrow blade spacings, such as 19 mm, may be obtained. The number of adjustable saw blades in the construction according to the invention is not as restricted as in known equipment presently used. A saw with six or even more adjustable saw blades can be easily provided. The method of shifting and guiding of the saw blade according to the invention is suited to all kinds of circular saw machines. Neither the bottom of the splines in the arbor nor the bars have to be round in shape.

FIG. 3 illustrates a sawmill machine provided with six adjustable circular saw blades $1_1$–$1_6$ disposed on one arbor 2. Each circular saw blade and the guide therefor is connected with three shifter bars attached to a respective one of connecting plates $10_1$–$10_6$ such being moved by a respective one of shifting cylinders $11_1$–$11_6$. The drive motor 16 is disposed on the saw frame 6. The blade arbor 2 is rotated by means of a belt pulley drive 17, 18, arranged between the saw frame and the circular saw blades.

We claim:

1. A circular saw comprising:

a plurality of circular saw blades;

a splined blade arbor having splines of a predetermined shape;

mounting means for mounting said blades on said splined blade arbor in side-by-side relationship with spacing therebetween so that the spacing between the blades and positions of the blades along said blade arbor are adjustable;

a plurality of saw blade guides;

at least one guide arbor on which said guides are mounted;

said guides operatively engaging said saw blades at portions thereof radially remote from said blade arbor;

a plurality of shifter bars associated with each of said blade arbor and said guide arbor, said shifter bars being slideably disposed in splines and having a shape matching the shape of the splines; and a common actuator means connected to the shifter bars for each blade, and the guide associated therewith, so that upon movement of said actuator means there is produced simultaneous displacement of an equal amount of both the blade mounting means and the guide for a respective circular saw blade.

2. A circular saw as recited in claim 1, wherein said shifter bars are circular in cross-section, and three in number for each blade and guide, and spaced circumferentially approximately 120° from each other around the arbor with which they are associated.

3. A circular saw as recited in claim 1, wherein said guides act on outer edge portions of said circular saw blades, one guide associated with each blade.

4. A circular saw as recited in claim 1, wherein the number of splines in said blade arbor, and the number of splines in said guide arbor, in n times 3, where "n" is the number of circular saw blades.

5. A circular saw as recited in claim 2, wherein the number of splines in said blade arbor, and the number of splines in said guide arbor, is n times 3, where "n" is the number of circular saw blades.

6. A circular saw as recited in claim 1, wherein said actuator means comprises a connecting plate adjustably displaceable by a shifting cylinder, one connecting plate and associated shifting cylinder being associated with each blade and respective guide.

7. A circular saw as recited in claim 6, wherein each connecting plate is guided for linear movement by a parallel guiding mechanism.

8. A circular saw as recited in claim 7, wherein said parallel guiding mechanism comprises a synchronizing shaft rotatably mounted to said connecting plate, a pair of feed racks, and a pair of gear wheels, said gear wheels being connected adjacent both ends of said synchronizing shaft and engaging said feed racks.

9. A circular saw as recited in claim 1, wherein the number of circular saw blades, with associated guides, is more than four.

10. A circular saw as recited in claim 1, further comprising means for effecting rotation of said blade arbor operatively engaging said blade arbor between said circular saw blades and said actuator means.

11. A circular saw as recited in claim 9, further comprising means for effecting rotation of said blade arbor operatively engaging said blade arbor between said circular saw blades and said actuator means.

12. A circular saw as recited in claim 5, wherein said actuator means comprises a connecting plate adjustably diplaceable by a shifting cylinder, one connecting plate and associated shifting cylinder being associated with each blade and respective guide.

13. A circular saw as recited in claim 12, wherein each connecting plate is guided for linear movement by a parallel guiding mechanism.

14. A circular saw as recited in claim 13, wherein said parallel guiding mechanism comprises a synchronizing shaft rotatably mounted to said connecting plate, a pair of feed racks, and a pair of gear wheels, said gear wheels being connected adjacent both ends of said synchronizing shaft and engaging said feed racks.

15. A circular saw as recited in claim 14, wherein the number of circular saw blades, with associated guides, is more than four.

16. A circular saw as recited in claim 14, further comprising means for effecting rotation of said blade arbor operatively engaging said blade arbor between said circular saw blades and said actuator means.

* * * * *